US012606348B2

(12) United States Patent
Padungchat et al.

(10) Patent No.: US 12,606,348 B2
(45) Date of Patent: Apr. 21, 2026

(54) CLOSURE DEVICE

(71) Applicant: Inteplast Group Corporation, Livingston, NJ (US)

(72) Inventors: Charin Padungchat, Chonburi (TH); Sema Srisai, Chonburi (TH); Boonrasin Sonechai, Chonburi (TH); Uthai Rodleang, Chonburi (TH); Weerachon Phueksopha, Chonburi (TH); Chakit Kamaiam, Chonburi (TH); Jiramate Wijakkanawuttanar, Chonburi (TH)

(73) Assignee: INTEPLAST GROUP CORPORATION, Livingston, NJ (US)

( * ) Notice: Subject to any disclaimer, the term of this patent is extended or adjusted under 35 U.S.C. 154(b) by 264 days.

(21) Appl. No.: 17/524,855

(22) Filed: Nov. 12, 2021

(65) Prior Publication Data

US 2023/0150730 A1 May 18, 2023

(51) Int. Cl.
*B65D 33/25* (2006.01)

(52) U.S. Cl.
CPC ..... *B65D 33/2541* (2013.01); *B65D 33/2566* (2013.01)

(58) Field of Classification Search
CPC ... B65D 33/2541; B65D 33/2566; B29D 5/10
USPC ..... 383/63–65
See application file for complete search history.

(56) References Cited

U.S. PATENT DOCUMENTS

| | | | | |
|---|---|---|---|---|
| 5,070,584 | A | 12/1991 | Dais et al. | |
| 5,138,750 | A | 8/1992 | Gundlach et al. | |
| 5,464,098 | A | 11/1995 | Tseng et al. | |
| 5,478,228 | A | 12/1995 | Dais et al. | |
| 5,562,580 | A | 10/1996 | Beasley et al. | |
| 5,647,100 | A | 7/1997 | Porchia et al. | |
| 5,878,468 | A | 3/1999 | Tomic et al. | |
| 5,962,040 | A | 10/1999 | Dais et al. | |
| 6,594,872 | B2 | 7/2003 | Cisek | |
| 8,132,692 | B2 | 3/2012 | Jordan | |
| 8,192,085 | B2 * | 6/2012 | Pawloski | B65D 33/2558 383/65 |
| 8,578,572 | B2 | 11/2013 | Ackerman et al. | |
| 8,926,179 | B2 * | 1/2015 | Ackerman | B65D 33/255 24/399 |
| 8,999,219 | B2 | 4/2015 | Plourde et al. | |
| 9,015,910 | B2 * | 4/2015 | Septien Rojas | A44B 19/16 24/399 |
| 9,193,505 | B2 | 11/2015 | Kosub, Sr. et al. | |
| 9,260,225 | B2 * | 2/2016 | Anzini | B65D 33/2558 |
| 9,914,563 | B2 | 3/2018 | Pawloski | |

(Continued)

*Primary Examiner* — Jes F Pascua
(74) *Attorney, Agent, or Firm* — Stinson LLP

(57) ABSTRACT

A reclosable bag comprising a first wall and a second wall, a zipper, and a plurality of impressions. The first and second wall form a product pouch and a mouth, where the mouth is configured to the selectively closable. The zipper further comprises a first profile and a second profile that can be releasably interlocked with each other. The plurality of impressions are formed immediately over and extend into the one or both or the first or second profile along the length of the zipper. The impressions are in an angled orientation with each other to form a generally zigzag pattern such that when the first and second profile are interlocked, a user receives tactile and audible feedback.

14 Claims, 9 Drawing Sheets

(56) References Cited

U.S. PATENT DOCUMENTS

| | | | | |
|---|---|---|---|---|
| 2009/0190860 | A1* | 7/2009 | Kettner | B65D 33/2508 383/5 |
| 2011/0044566 | A1* | 2/2011 | Fish | B65D 33/007 383/63 |
| 2012/0027322 | A1* | 2/2012 | Ackerman | B65D 33/255 24/400 |
| 2014/0143988 | A1* | 5/2014 | Septien Rojas | B65D 33/255 24/402 |
| 2015/0049962 | A1* | 2/2015 | Bois | B65D 33/25 383/63 |
| 2015/0367995 | A1* | 12/2015 | Turvey | B65D 33/2558 383/63 |

* cited by examiner

CLOSURE DEVICE

FIELD

The present disclosure generally relates to closure devices with a zipper.

BACKGROUND

Zippers with tactile and auditory feedback have been used in the past. One example of this arrangement is disclosed in U.S. Pat. No. 9,193,505, the disclosure of which is incorporated herein by reference. In the '505 patent, impressions where formed in a male and/or female member of a closure of a polymeric bag. These impressions were all oriented in the same direction, perpendicular to the lengthwise extent of the closure (or "zipper"). The impressions had the effect of producing an audible noise upon closure and provided vibrations which were tactilely sensible to the user to facilitate proper connection of the male and female members of the closure. However, the noise produced changed depending upon the direction of the closure producing confusion about whether the closure had been properly engaged.

SUMMARY

In one aspect, a reclosable bag constructed according to the principles of the present invention generally comprises a first wall and a second wall. The first and second wall are configured to form a product pouch and a mouth configured to the selectively closable. The mouth allows product to be inserted into and removed from the product pouch of the reclosable bag. A zipper comprises a first profile and a second profile that are configured to be selectively interlocked with each other to close the mouth of the reclosable bag. Each profile has a length and a longitudinal axis extending along the length. A plurality of impressions are formed into the first profile along a length of the zipper, where at least some of the impressions are oriented differently than others of the impressions with respect to the longitudinal axis of the first profile.

In yet another aspect, a reclosable bag constructed according to the principles of the present invention generally comprises a first wall and a second wall. The first and second wall are configured to form a product pouch and a mouth configured to the selectively closable. The mouth allows product to be inserted into and removed from the product pouch of the reclosable bag. A zipper comprises a first profile and a second profile that are configured to be selectively interlocked with each other to close the mouth of the reclosable bag. Each profile has a length and a longitudinal axis extending along the length. A plurality of impressions are formed into the first profile along a length of the zipper, where at least some of the impressions extend transversely of the first profile at a nonorthogonal angle with respect to the longitudinal axis of the first profile.

In still another aspect of the present invention, a method of making a reclosable bag generally comprises forming a product pouch from a first wall and a second wall, where the first and second walls are connected at a bottom, a first side and a second side and define a mouth on a top side providing access to the product pouch. A zipper is provided to releasably close the mouth. The zipper is formed using a former to create a row of impressions immediately over and extending into the first zipper, at least some of the impressions being arranged in different orientations than other of the impressions.

Other objects and features of the present disclosure will be in part apparent and in part pointed out herein.

BRIEF DESCRIPTION OF THE DRAWINGS

Corresponding reference numbers indicate corresponding parts throughout the drawings.

DETAILED DESCRIPTION

Figure 1:
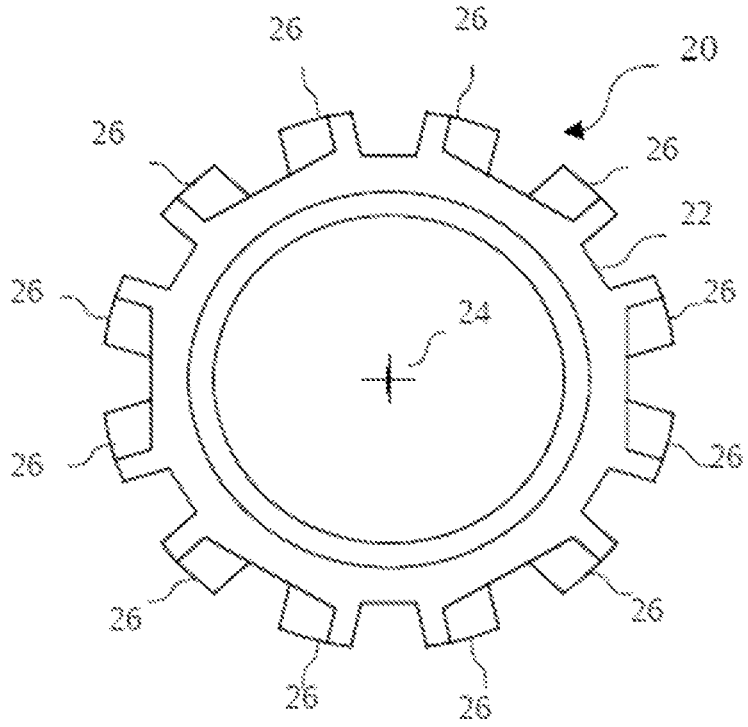
FIG. 1 is an end plan view of a forming wheel.
Figure 2:
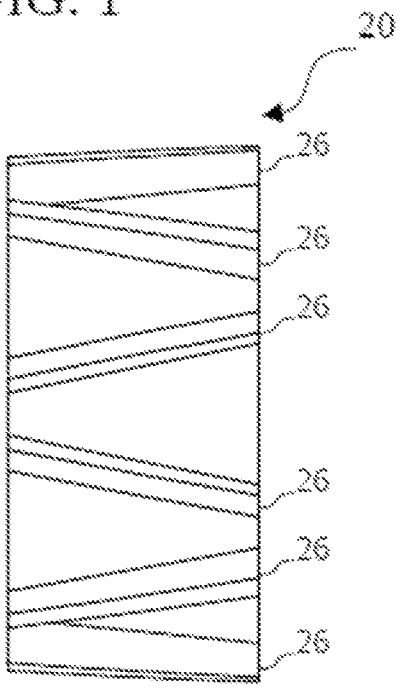
FIG. 2 is a side plan view of the forming wheel.
Figure 3:
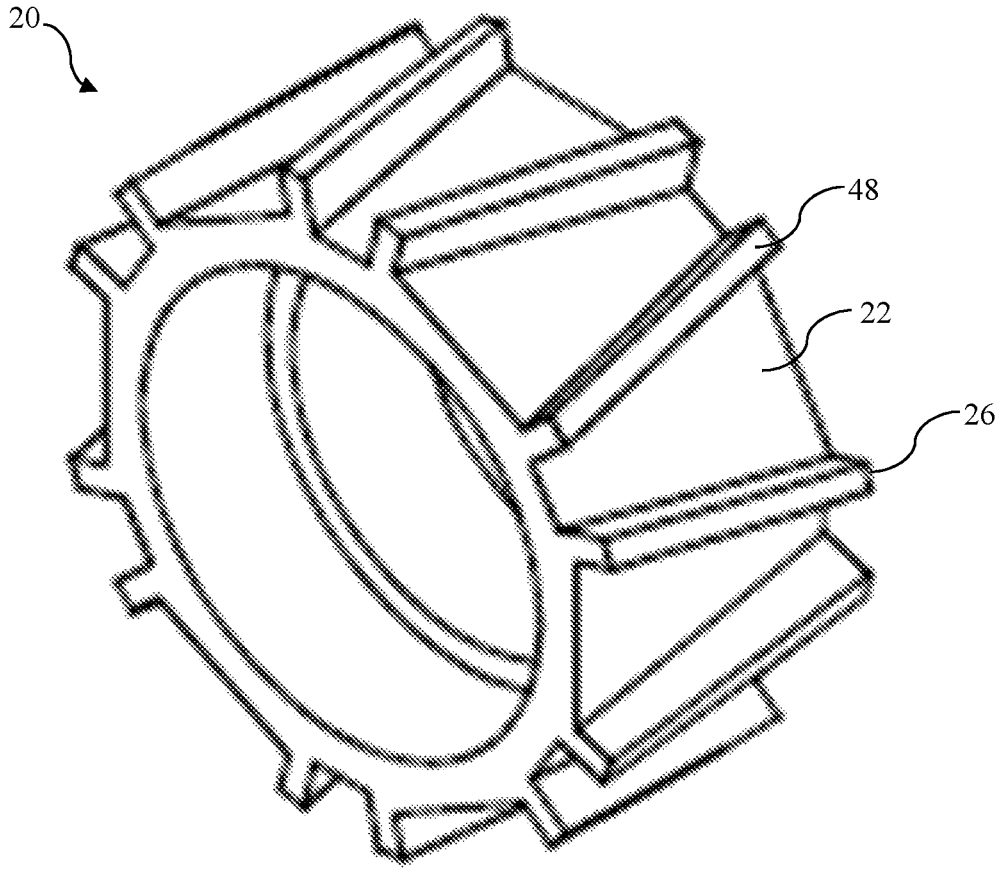
FIG. 3 is a perspective view of the forming wheel.

Referring to FIGS. 1-3, a forming wheel 20 is shown. The forming wheel 20 is typically manufactured out of a metal or similar material, though other types of materials are contemplated by this disclosure. The forming wheel 20 has a generally cylindrical shape defined by an outer cylindrical surface 22 and is configured to rotated about a first rotational axis 24. A plurality of forming teeth 26 are spaced circumferentially along the cylindrical surface 22 and extend outwardly from the cylindrical surface. The forming teeth 26 are not all oriented in the same way with respect to the first rotational axis 24 of the forming wheel 20. In the illustrated embodiment, the forming teeth 26 extend in directions that are nonparallel with the first rotational axis 24. As shown, the forming teeth 26 are all skew with respect to the first rotational axis 24. More specifically in regard to the illustrated embodiment, the forming teeth 26 alternate in the angle they make with respect to the first rotational axis 24 about the circumference of the outer cylindrical surface 24. It may be said that the forming teeth 26 shown in the drawings form a generally zigzag pattern. It will be understood that other arrangements may be used within the scope of the present invention so long as at least one or more of the forming teeth are not parallel to the first rotational axis 24.

Figure 4:
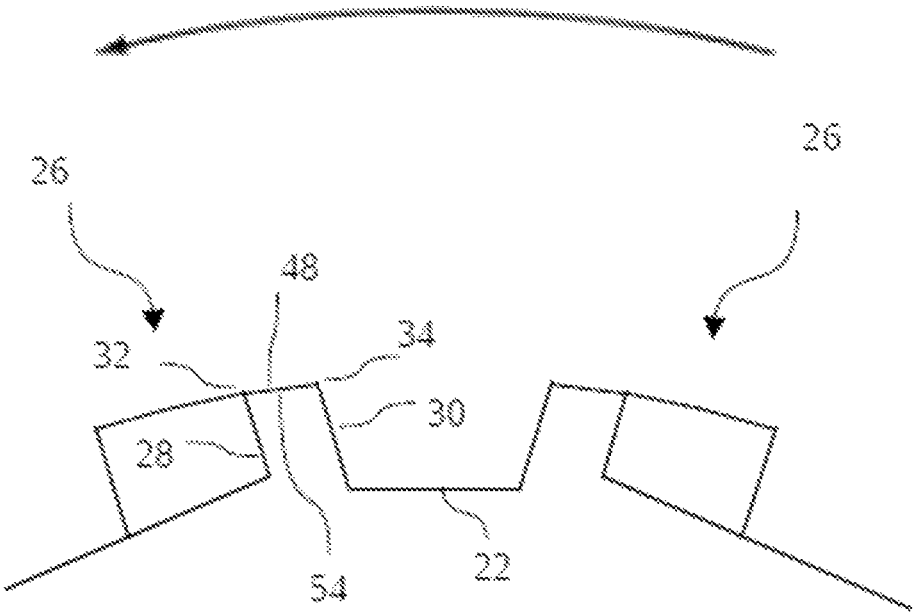
FIG. 4 is an enlarged, fragmentary side view showing the details of the teeth of the forming wheel.

Referring to FIG. 4, a detailed view of the forming teeth 26 is shown looking axially along the cylindrical surface 22. The forming teeth 26 further comprise leading edge surface of the tooth 28, a trailing edge surface of the tooth 30, and a distal surface of the tooth 48. The leading edge surface 28 and trailing edge surface 30 are determined by the illustrated direction of rotation.

Figure 5:
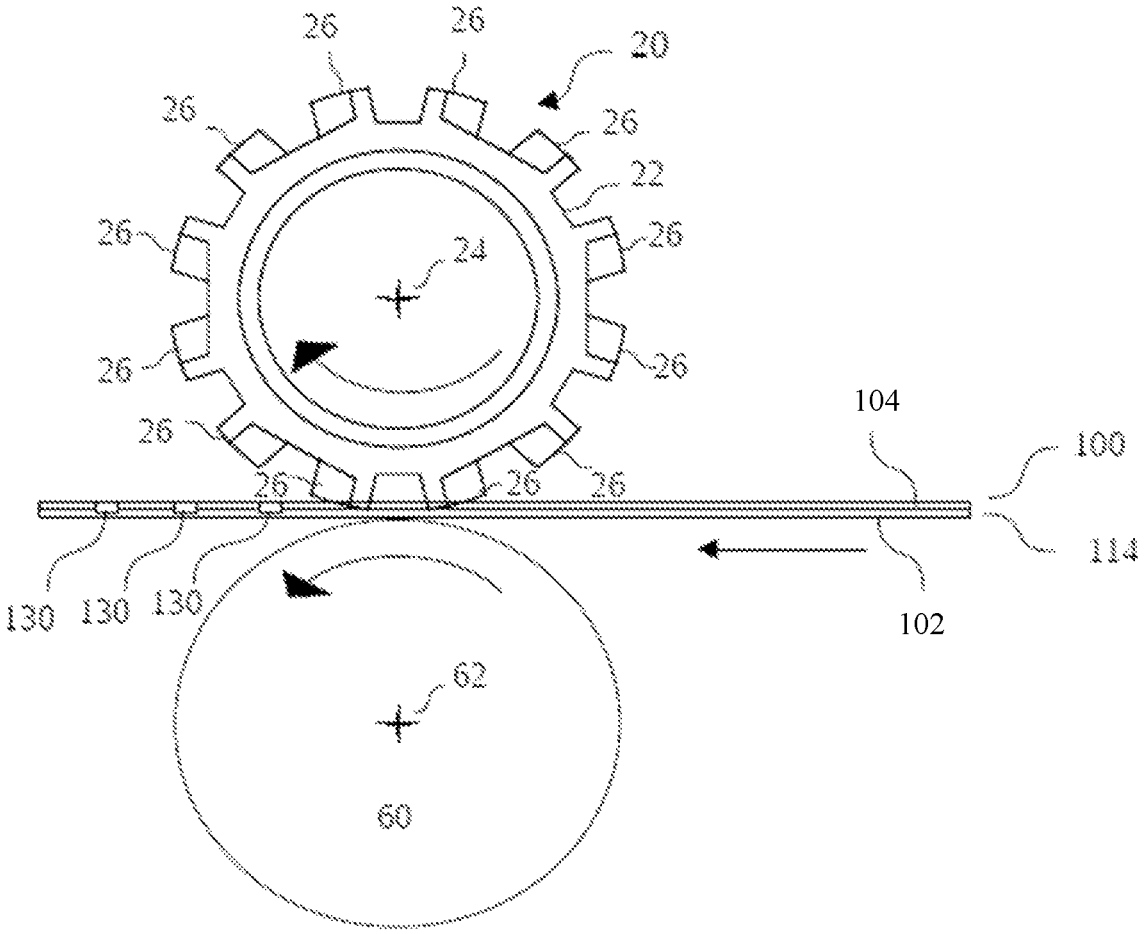
FIG. 5 is a side view of the forming wheel engaging a reclosable plastic package.
Figure 6:
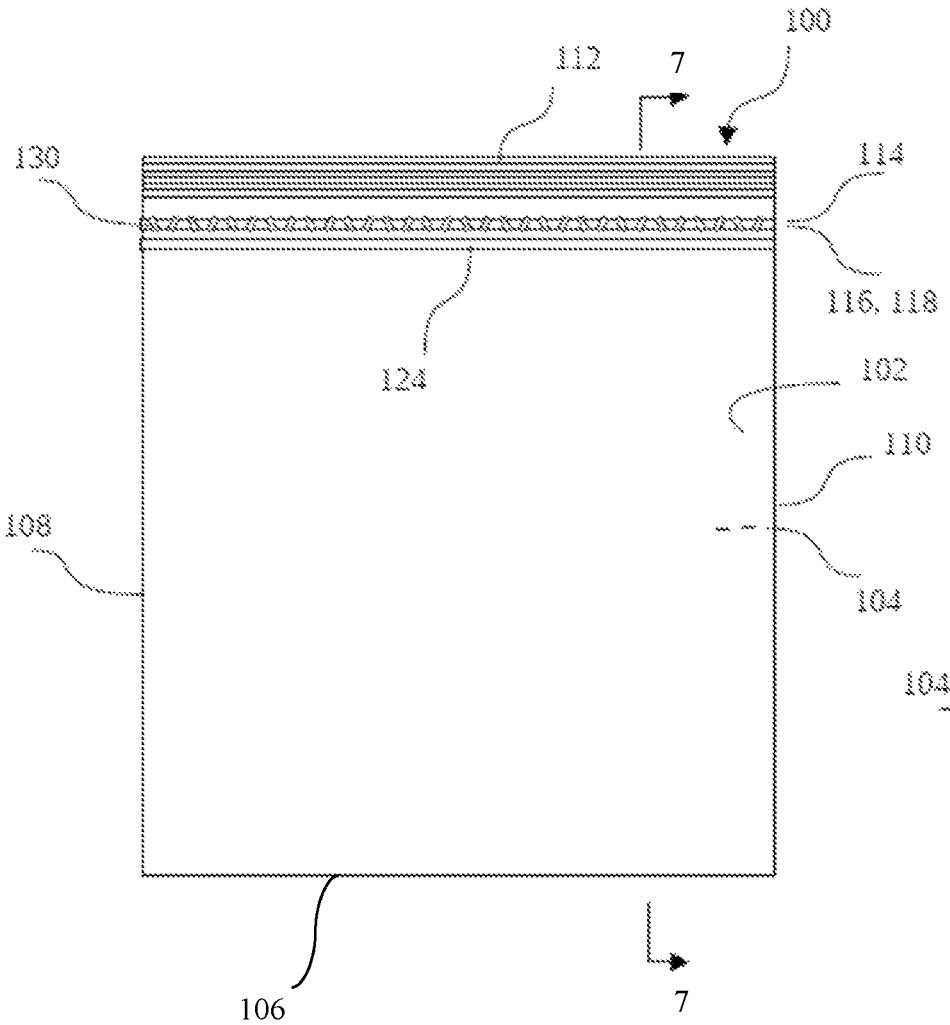
FIG. 6 is a front view of the plastic package upon which the forming wheel has been applied.
Figure 7:
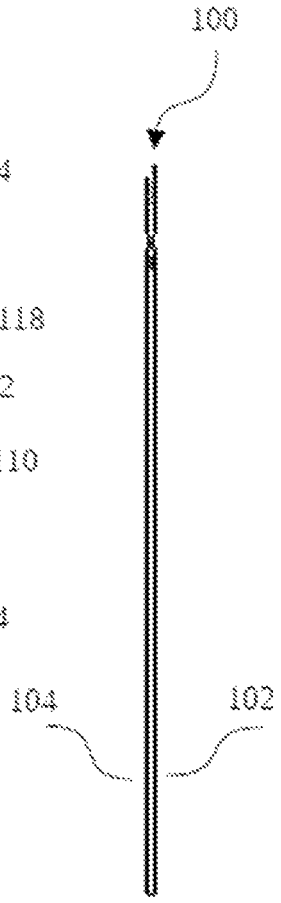
FIG. 7 is a cross sectional view along plane 7-7 of FIG. 5.
Figure 8:
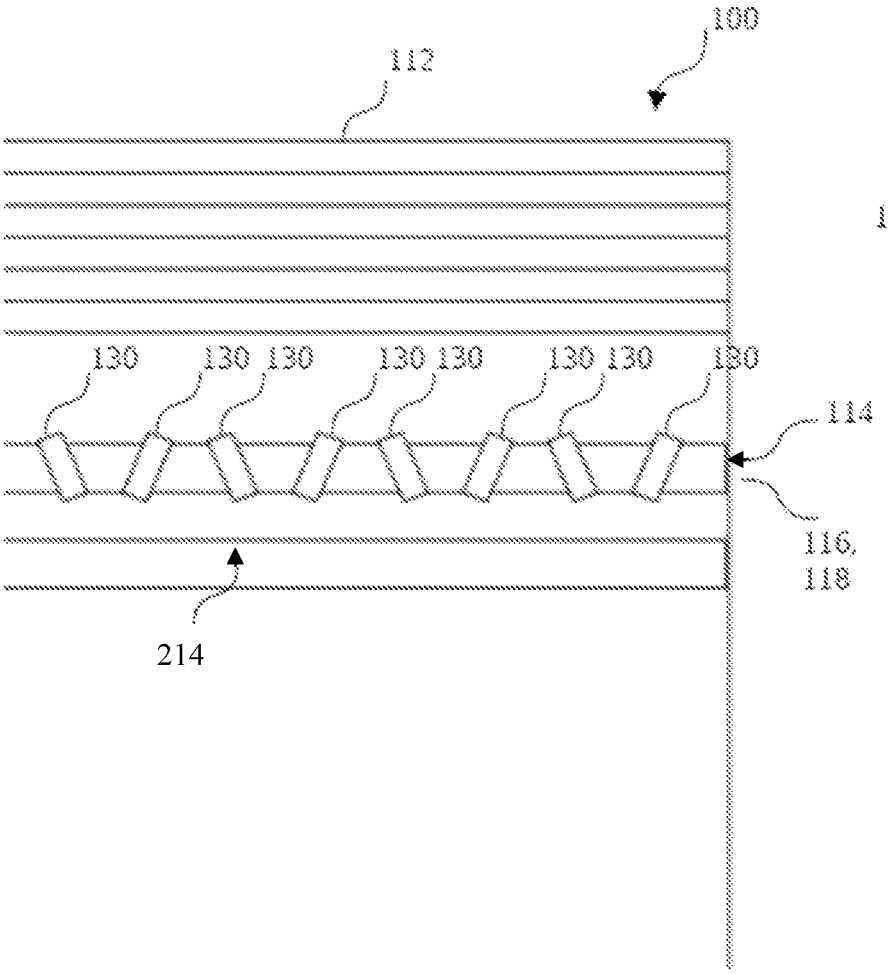
FIG. 8 is an enlarged fragment of the bag of FIG. 6.
Figure 9:
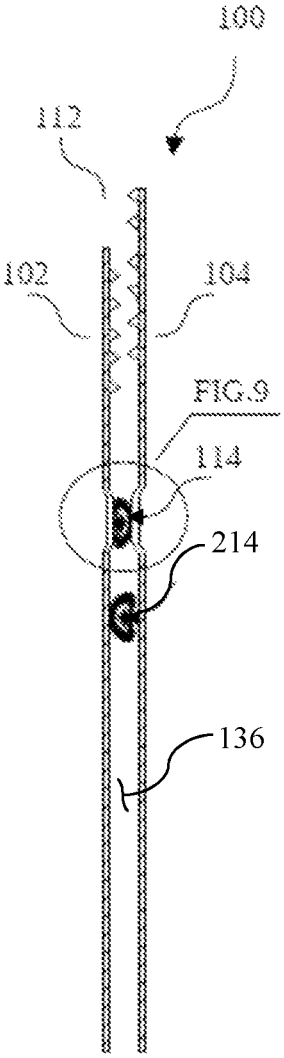
FIG. 9 is an enlarged fragment of FIG. 7 in greater detail.
Figure 10:
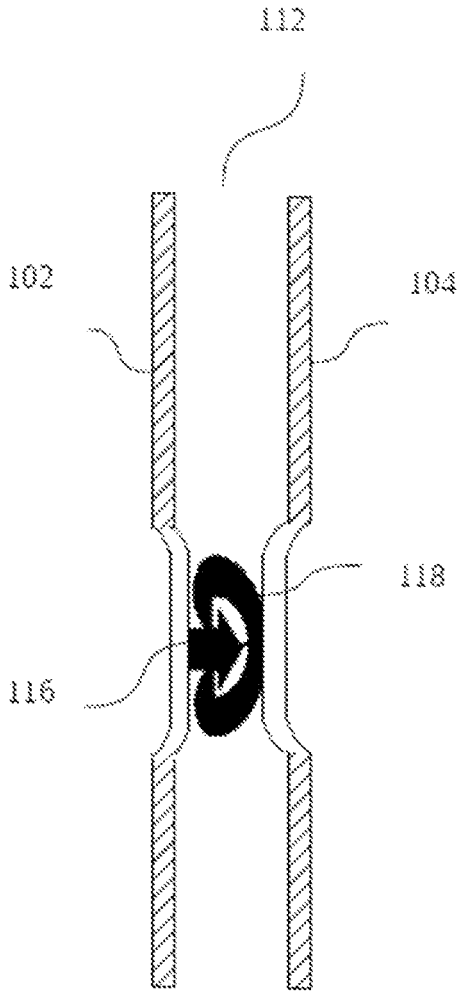
FIG. 10 is a further enlarged fragment of portion of FIG. 9.

Referring to FIG. 5, the forming wheel 20 is shown rotating around first rotational axis 24. The forming wheel 20 is positioned to be opposed to a pressure roller 60, which is configured to rotate about second rotational axis 62. The forming wheel 20 and pressure roller 60 are configured to engage a reclosable container in the form of a polymeric bag 100, which is fed between the forming wheel and pressure roller. In the illustrated embodiment, a first zipper 114 of the reclosable bag 100 is placed between the forming wheel 20 and the pressure roller 60. The first zipper 114, as will be explained in further detail below, comprises a male profile 116 and a female profile 118 which are configured to be selectively interlocked with each other. For purposes of this description either of the male and female profiles may be broadly considered a "first" or a "second" profile. The zipper 114 and the male and female profiles 116, 118 are elongate, and the male and female profiles each have a longitudinal axis. The male profile 116 and the female profile 118 are connected together when the zipper 114 is passed between the forming wheel 20 and the pressure roller 60. The zipper 114 is oriented so that the first wall 102 is on the bottom and the male profile 116 projects up from the first wall toward the forming wheel 20. The reclosable bag 100 is illustrated as moving in the direction indicated by the arrow in FIG. 5 between the rotating forming wheel 20 and the pressure roller 60. More specifically, the forming wheel moves over the zipper 114 of the reclosable bag 100, resulting in the forming teeth 26 forming successive rectangular shaped impressions 130 in the male profile 116. The impressions 130 are in an angled alternately in opposite directions with respect to the longitudinal axis of the male profile 116 and form a generally zigzag pattern. As illustrated, the pattern is formed into both of the male profile 116 and the female profile 118 by passing the reclosable bag 100 through the forming wheel 20 and pressure roller 60 in an inverted position (i.e., with the second wall 104 on the bottom) to form impressions 130 on the female profile. However, it will be understood that the pattern could be formed only into one or the other of the zipper profiles 116, 118.

Referring to FIGS. 6-10, the resulting reclosable bag 100 is shown. The reclosable bag 100 is further comprised of a first wall 102, a second wall 104, a bottom seal 106, a first side seal 108 and a second side seal 110, and a mouth 112. The seals may be formed in any suitable manner, such as by heat sealing, adhesive or by simply folding the plastic back on itself to that the material extends continuously through the side. The reclosable bag 100 is made out of a suitable material, such as a polymer. The first and second walls 102, 104 are sealed together at the edges to form the mouth 112. The mouth is configured to be reclosable using the first zipper 114. The first zipper 114, as mentioned above, comprises a male and a female profile 116, 118, wherein the male profile is configured to be sealed or otherwise attached to the first wall 102 and the female profile is sealed or otherwise attached to the second wall 104. Moreover, the zipper profiles 116, 118 or either of them could be formed as one piece with the first wall, such as in an extrusion process. The male profile 116 is configured to be selectively engaged with the female profile 118 to selectively retain the mouth 112 in a closed, substantially sealed condition. The reclosable bag 100 defines a product pouch 136 bounded between the mouth 112, the bottom seal 106, the first side seal 108 and the second side seal 110. The product pouch 136 is accessible via the mouth 112 in order to insert product into and remove product from the reclosable bag 100.

In the illustrated embodiment, the rectangular shaped impressions 130 are formed immediately over and extend into both the male profile 116 and the female profile 118. In the illustrated embodiment, the reclosable bag 100 further comprises a second zipper 214, the second zipper comprising a second male profile 216 and a second female profile 218. The second male and female profiles 216, 218 may be broadly considered as "third" and "fourth" profiles. The second zipper 214 is configured to be on the product pouch 136 side of the first zipper 114. It will be understood that the second zipper 214 may be omitted within the scope of the present invention. As illustrated, the second zipper 214 is not shaped by the forming wheel 20. However, the second zipper 214 could also be formed with indentations (not shown).

Figure 11:
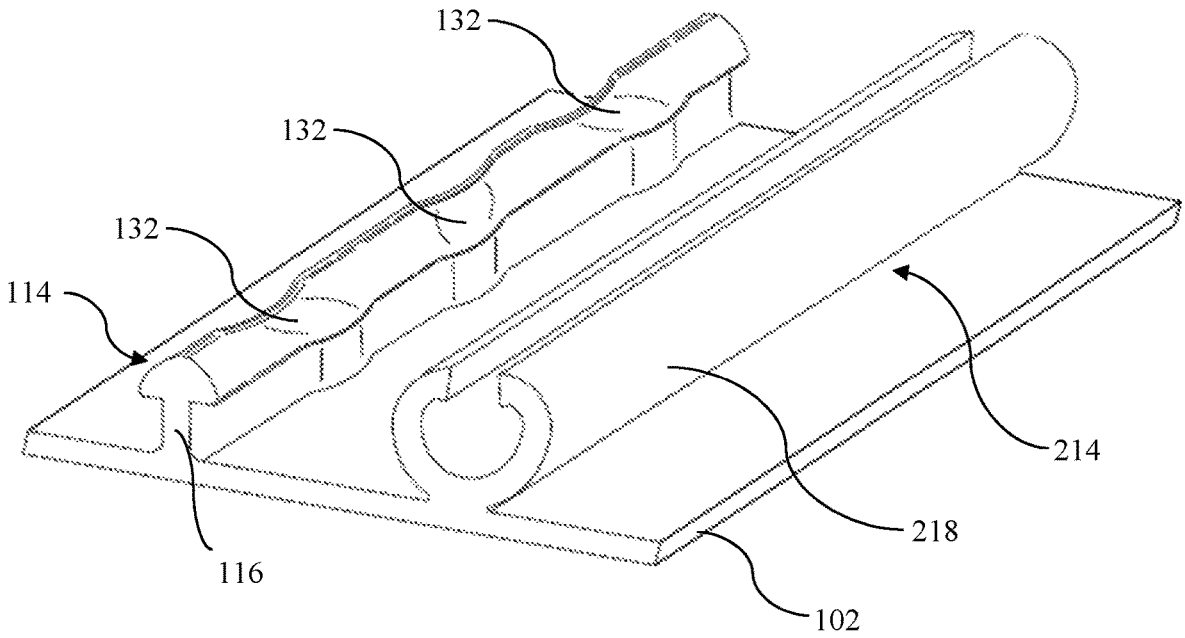
FIG. 11 is an enlarged perspective of elements of first and second zippers on the first wall.
Figure 12:
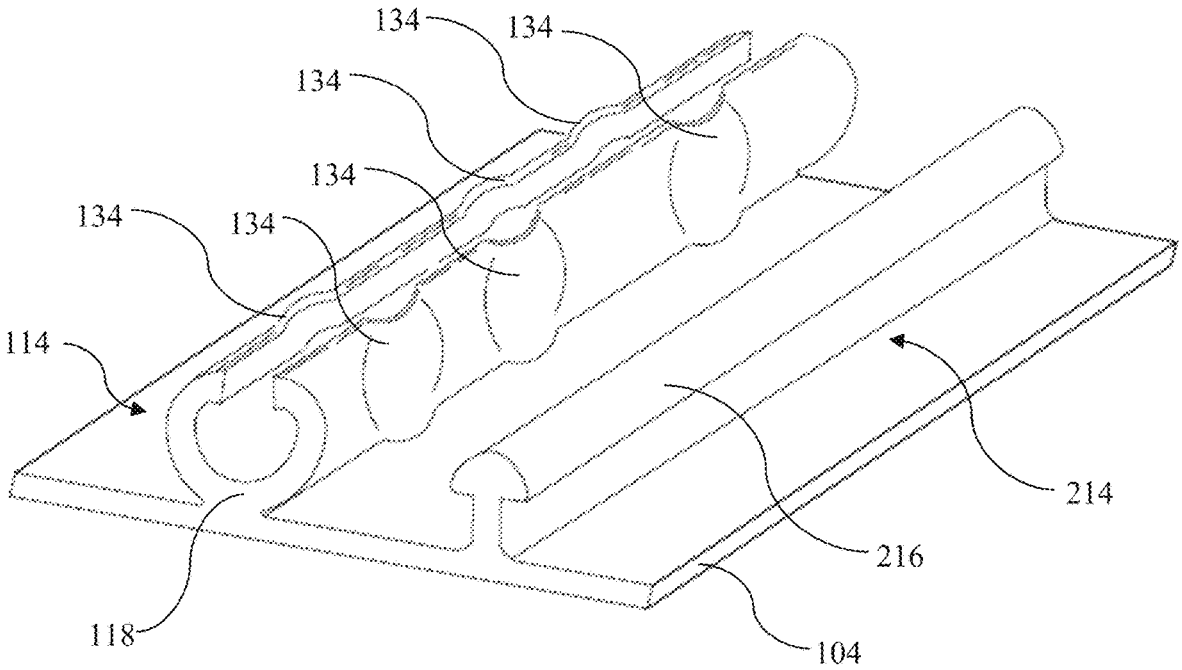
FIG. 12 is an enlarged perspective of elements of the first and second zippers on the second wall.

Referring to FIGS. 11-13, the reclosable bag 100 further includes a row of notches 132, 134 formed from the rectangular shaped impressions 130 which extend into at least one or both of the male profile 116 and the female profile 118 of the first zipper 114. The notches 132, formed on the male profile 116, and the notches 134, formed on the female profile 118, are created by the deformation of at least one of the profiles 116, 18 during the operation performed in FIG. 5. This deformation results in tactile and audible feedback during the sealing of the first zipper 114 during the closure of the mouth. Moreover, it has surprisingly been found that the sound produced by connection of the male and female profiles 116, 118 is the same regardless of whether the bag 100 is closed from right to left or left to right. This provides confidence that the mouth 112 has been closed. In addition, the configuration results in an enhanced appearance of the reclosable bag 100.

An exemplary method of making the reclosable bag 100 described above will now be briefly described. First, the method comprises forming a product pouch 136 from a first wall 102 and a second wall 104, wherein the first and second walls are sealed at a bottom seal 106, a first side seal 108, and a second side seal 110, and wherein the a reclosable mouth forms the final edge of the product pouch. Second, the method comprises connecting a first zipper 114 to the mouth 112 of the reclosable bag 100. As illustrated, the male profile 116 is attached to the first wall 102 and the female profile 118 is attached to the second wall 104. As stated previously, the male and female profiles 116, 118 could be formed as one piece with their respective walls 102, 104. The male and female profiles 116, 118 are configured to engaged with each other in order to selectively close and open the mouth 112 to allow a product to be placed within the product pouch 136. Next, the method comprises feeding the reclosable bag 100 between the forming wheel 20 and pressure roller 60. The forming teeth 26 are in an angled orientation with each other to form a generally zigzag pattern. The reclosable bag 100 is configured to be fed into the forming wheel 20 such that the first zipper 114 engages the forming wheel. In the illustrated embodiment of the method, the method comprises feeding the first zipper 114 into the forming wheel 20 such that the forming wheel teeth 26 bear against the male profile 116 and rectangular shaped impressions are formed immediately over and extend into the male profile. The bag 100 is then fed again between the forming wheel 20 and pressure roller 60 so that the forming wheel bears against the female profile 118 and rectangular shaped impressions are formed immediately over and extend into the male profile. In other non-limiting embodiment, the bag 100 may be fed through the forming wheel 20 and pressure roller 60 in only one orientation. Moreover, the bag 100 could be not fully constructed so that the male profile 116 and female profile 118 could be fed through the forming wheel 20 and pressure roller 60 independently. As a result of the feeding process, a row of notches 132 on the male profile and a row of notches 134 on the female profile of the first zipper 114 are formed as a result of the deformation of the profiles. These notches thus result in tactile and audible feedback during operation of the first zipper 114 (i.e., interlocking or separating the profiles 116, 118). The second zipper 214 is not shaped by the forming wheel 20 and pressure roller 60 in the illustrated embodiment.

When introducing elements of aspects of the invention or the embodiments thereof, the articles "a," "an," "the," and "said" are intended to mean that there are one or more of the elements. The terms "comprising," "including," and "having" are intended to be inclusive and mean that there may be additional elements other than the listed elements.

Not all of the depicted components illustrated or described may be required. In addition, some implementations and embodiments may include additional components. Variations in the arrangement and type of the components may be made without departing from the spirit or scope of the claims as set forth herein. Additional, different or fewer components may be provided and components may be combined. Alternatively, or in addition, a component may be implemented by several components.

The above description illustrates the aspects of the invention by way of example and not by way of limitation. This description enables one skilled in the art to make and use the aspects of the invention, and describes several embodiments, adaptations, variations, alternatives and uses of the aspects of the invention, including what is presently believed to be the best mode of carrying out the aspects of the invention. Additionally, it is to be understood that the aspects of the invention are not limited in its application to the details of construction and the arrangement of components set forth in the following description or illustrated in the drawings. The aspects of the invention are capable of other embodiments and of being practiced or carried out in various ways. Also, it will be understood that the phraseology and terminology used herein is for the purpose of description and should not be regarded as limiting.

It will be apparent that modifications and variations are possible without departing from the scope of the invention defined in the appended claims. As various changes could be made in the above constructions and methods without departing from the scope of the invention, it is intended that all matter contained in the above description and shown in the accompanying drawings shall be interpreted as illustrative and not in a limiting sense.

The Abstract and Summary are provided to help the reader quickly ascertain the nature of the technical disclosure. They are submitted with the understanding that they will not be used to interpret or limit the scope or meaning of the claims. The Summary is provided to introduce a selection of concepts in simplified form that are further described in the Detailed Description. The Summary is not intended to identify key features or essential features of the claimed subject matter, nor is it intended to be used as an aid in determining the claimed subject matter.

What is claimed is:

1. A reclosable bag, the reclosable bag comprising:

a first wall and a second wall, the first and second wall being configured to form a product pouch and a mouth configured to be selectively closable, wherein the mouth allows product to be inserted into and removed from the product pouch of the reclosable bag;

a zipper comprising a first profile and a second profile, wherein the first and second profile are configured to be selectively interlocked with each other to close the mouth of the reclosable bag, each profile having a height, a width, and a length, and a longitudinal axis extending along the length, a transverse axis perpendicular to the longitudinal axis and extending along the width and a height axis perpendicular to the longitudinal axis and the transverse axis and extending along the height of each profile; and a plurality of impressions formed into the first profile along a length of the zipper, each impression extending into the first profile in a direction parallel to the height axis, the plurality of impressions including a first set of impressions and a second set of impressions, each impression extending across the width of the first profile along a line making an angle which is skew to the longitudinal axis of the first profile, the first set of impressions extending transversely of the first profile longitudinal axis and defining a first skew angle with respect to the longitudinal axis of the first profile, the first set of impressions being located at spaced apart locations over the entire length of the first profile, the second set of impressions extending transversely of the first profile longitudinal axis and defining a second skew angle with respect to the longitudinal axis of the first profile, the second skew angle being skewed oppositely of the first skew angle with respect to a transverse axis of the first profile that is perpendicular to the longitudinal axis of the first profile, the second set of impressions being located at spaced apart locations over the entire length of the first profile, wherein at least some first impressions of the first set of impressions are spaced apart from nearest adjacent second impressions of the second set of impressions along the longitudinal axis of the first profile.

2. A reclosable bag as set forth in claim 1 wherein the impressions alternate between the impressions of the first set of impressions and impressions of the second set of impressions along the length of the first profile.

3. A reclosable bag as set forth in claim 2 further comprising a plurality of impressions formed in the second profile.

4. A reclosable bag as set forth in claim 3, wherein at least some of the impressions in the second profile are skew with respect to the longitudinal axis of the second profile.

5. A reclosable bag as set forth in claim 4 wherein the impressions in the second profile extend transverse to the length of the second profile.

6. A reclosable bag as set forth in claim 5 wherein the impressions in the second profile are arranged in two orientations with respect to the longitudinal axis of the second profile.

7. A reclosable bag as set forth in claim 6 wherein the impressions in the second profile alternate between the two orientations along the length of the second profile.

8. A reclosable bag as set forth in claim 1, wherein the first profile is a male profile and the second profile is a female profile.

9. A reclosable bag as set forth in claim 1, wherein the reclosable bag further comprises a second zipper.

10. A reclosable bag as set forth in claim 9, wherein the second zipper comprises a third profile and a fourth profile.

11. A reclosable bag as set forth in claim 10, wherein the third and fourth profiles are free of impressions.

12. A reclosable bag, the reclosable bag comprising:

a first wall and a second wall, the first and second wall being configured to form a product pouch and a mouth configured to be selectively closable, wherein the mouth allows product to be inserted into and removed from the product pouch of the reclosable bag;

a zipper comprising a first profile and a second profile, wherein the first and second profile are configured to be selectively interlocked with each other to close the mouth of the reclosable bag, each profile having a length and a longitudinal axis extending along the length; and a plurality of impressions formed into the first profile along a length of the zipper, the plurality of impressions including a first set of impressions and a second set of impressions, the first set of impressions extending transversely of the first profile longitudinal axis and defining a first skew angle with respect to the longitudinal axis of the first profile, the first set of impressions being located at spaced apart locations over the entire length of the first profile, the second set of impressions extending transversely of the first profile longitudinal axis and defining a second skew angle with respect to the longitudinal axis of the first profile, the second skew angle being skewed oppositely of the first skew angle with respect to a transverse axis of the first profile that is perpendicular to the longitudinal axis of the first profile, the second set of impressions being located at spaced apart locations over the entire length of the first profile, wherein at least some first impressions of the first set of impressions are spaced apart from nearest adjacent second impressions of the second set of impressions along the longitudinal axis of the first profile;

a plurality of impressions formed into the second profile along a length of the zipper, the plurality of impressions including a first set of impressions and a second set of impressions, the first set of impressions extending transversely of the second profile longitudinal axis and defining a first skew angle with respect to the longitudinal axis of the second profile, the first set of impressions being located at spaced apart locations over the entire length of the second profile, the second set of impressions extending transversely of the second profile longitudinal axis and defining a second skew angle with respect to the longitudinal axis of the second profile, the second skew angle being skewed oppositely of the first skew angle with respect to a transverse axis of the second profile that is perpendicular to the longitudinal axis of the second profile, the second set of impressions being located at spaced apart locations over the entire length of the second profile.

13. A method of making a reclosable bag, the method comprising:

forming a product pouch from a first wall and a second wall, wherein the first and second walls are connected at a bottom, a first side and a second side and define a mouth on a top side providing access to the product pouch;

providing a zipper configured to releasably close the mouth, the zipper comprising a male profile and a female profile configured to be selectively interlocked with each other to close the mouth of the reclosable bag; and forming the male profile of the zipper using a former to create a row of impressions immediately over and extending into the male profile, at least some of the impressions being arranged in a first orientation and others of the impressions being arranged in a second orientation different from the first orientation, at least some of the impressions of the first orientation being spaced apart from the nearest adjacent impression of the second orientation;

forming the female profile of the zipper using the former to create a row of impressions immediately over and extending into the female profile.

14. A method of making a reclosable bag as set forth in claim 13 wherein forming the first and second profiles of the zipper comprises forming the impressions into at least one of the first and second profiles of the zipper in alternating orientations with respect to a lengthwise extent of the zipper.

* * * * *